US006918221B2

(12) United States Patent
Williams

(10) Patent No.: US 6,918,221 B2
(45) Date of Patent: Jul. 19, 2005

(54) POLYMERIC DECK PANELS, DECK ASSEMBLIES, DECKS AND METHODS FOR FORMING THE SAME

(76) Inventor: Robert M. Williams, 7034 E. Court St., Davison, MI (US) 48423

( * ) Notice: Subject to any disclaimer, the term of this patent is extended or adjusted under 35 U.S.C. 154(b) by 57 days.

(21) Appl. No.: 10/215,250

(22) Filed: Aug. 8, 2002

(65) Prior Publication Data

US 2004/0025464 A1 Feb. 12, 2004

(51) Int. Cl.[7] ..... E04B 2/08

(52) U.S. Cl. ..... 52/592.1; 52/588.1; 52/589.1; 52/591.1; 52/592.1; 52/578; 52/582.1; 52/650.3; 52/730.5; 52/731.3; 52/732.2

(58) Field of Search ..... 52/483.1, 492.1, 52/177, 588.1, 589.1, 591.1, 592.1, 100, 650.3, 730.5, 731.3, 732.2; 114/263, 266

(56) References Cited

U.S. PATENT DOCUMENTS 5,819,491 A * 10/1998 Davis ..... 52/592.1

* cited by examiner

*Primary Examiner*—Jeanette Chapman
(74) *Attorney, Agent, or Firm*—Myers Bigel Sibley & Sajovec, P.A.

(57) ABSTRACT

A deck panel includes a generally planar body portion having an upper surface and first and second side surfaces on opposed sides of the upper surface. An elongated tongue extends outwardly from and along the first side surface. An elongated groove is defined in and extends along the second side surface, the groove being adapted to receive a second tongue. The deck panel is formed of a polymeric material.

40 Claims, 5 Drawing Sheets

POLYMERIC DECK PANELS, DECK ASSEMBLIES, DECKS AND METHODS FOR FORMING THE SAME

FIELD OF THE INVENTION

The present invention relates to polymeric decking and, more particularly, to polymeric decking panels and deck assemblies and decks formed from the same.

BACKGROUND OF THE INVENTION

Outdoor decks formed from wooden boards or panels suffer from a number of drawbacks. Typically, the boards must be periodically treated with a water sealant to inhibit degradation. Wooden decking may be difficult or impossible to effectively and efficiently clean. Wooden decking may be subject to rot and mold, for example.

In view of the foregoing deficiencies, polymeric deck panels, typically formed of vinyl or a vinyl composite, have been used in place of wooden panels for decks and the like. In some cases, the polymeric deck panels are secured to support joists and other frame elements by simply driving nails through the body of the panel and into the joists, etc. Some deck panels are provided with nail strips substantially coplanar with a lower face of the deck panel and through which the nails are driven. Such deck panels may be arranged such that the nail strip of each deck panel is covered by an adjacent deck panel. Other types of polymeric deck panels may be secured to joists by means of clips.

SUMMARY OF THE INVENTION

According to embodiments of the present invention, a deck panel includes a generally planar body portion having an upper surface and first and second side surfaces on opposed sides of the upper surface. An elongated tongue extends outwardly from and along the first side surface. An elongated groove is defined in and extends along the second side surface, the groove being adapted to receive a second tongue. The deck panel is formed of a polymeric material.

According to further embodiments of the present invention, a deck assembly includes first and second deck panels. Each of the first and second deck panels includes a generally planar body portion having an upper surface and first and second side surfaces on opposed sides of the upper surface. An elongated tongue extends outwardly from and along the first side surface. An elongated groove is defined in and extends along the second side surface. The deck panel is formed of a polymeric material. First and second deck panels are disposed in side-by-side arrangement and the tongue of the second deck panel is disposed within the groove of the first deck panel.

According to further embodiments of the present invention, a deck includes a deck assembly including first and second deck panels. Each of the first and second deck panels includes a generally planar body portion having an upper surface and first and second side surfaces on opposed sides of the upper surface. An elongated tongue extends outwardly from and along the first side surface. An elongated groove is defined in and extends along the second side surface. The deck panel is formed of a polymeric material. The first and second deck panels are disposed in side-by-side arrangement and the tongue of the second deck panel is disposed within the groove of the first deck panel. A joist extends below and supports each of the first and second deck panels.

According to method embodiments of the present invention, a method for forming a deck includes providing first and second deck panels. Each of the first and second deck panels includes a generally planar body portion having an upper surface and first and second side surfaces on opposed sides of the upper surface. An elongated tongue extends outwardly from and along the first side surface. An elongated groove is defined in and extends along the second side surface. The deck panel is formed of a polymeric material. The first and second deck panels are positioned in side-by-side arrangement such that the tongue of the second deck panel is disposed within the groove of the first deck panel.

Objects of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 1:
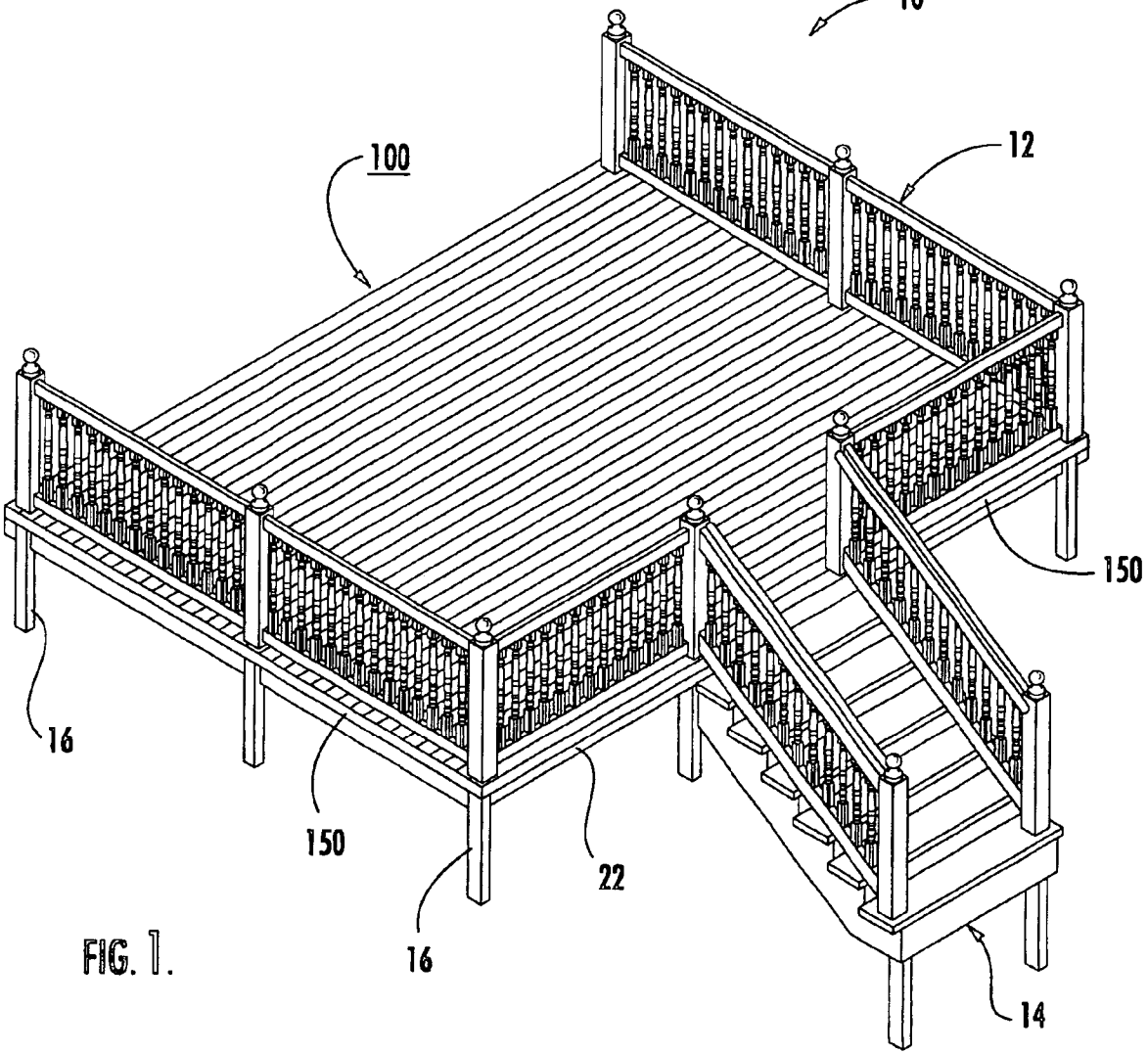
FIG. 1 is a perspective view of a deck according to embodiments of the present invention, the deck including a deck assembly according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present.

With reference to FIG. 1, a deck 10 according to embodiments of the present invention is shown therein. The deck 10 includes a deck assembly 100 according to embodiments of the present invention, railing 12, steps 14, posts 16, floor joists 20 (FIG. 2), and fascia boards 22. The railing 12 is preferably formed of a polymeric material and may include a reinforcement rail (e.g., formed of metal) with a surrounding polymeric cladding. The posts 16 may be formed of any suitable material and are preferably formed of or clad in a polymeric material above the levels of the joists 20. The joists 20 and fascia boards 22 may be formed of wood. The deck 10 may, for example, be attached to a structure such as a house.

Figure 2:
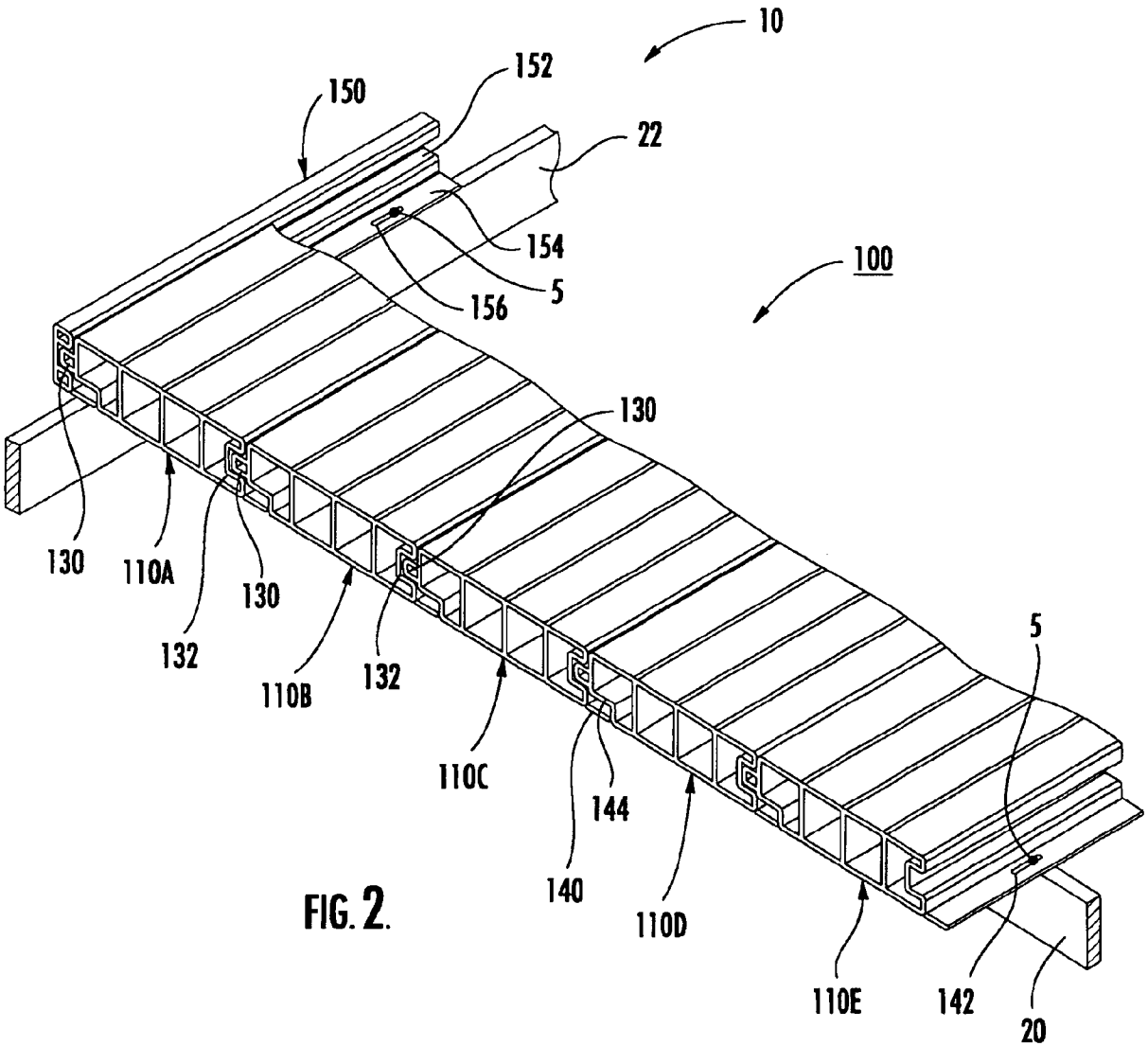
FIG. 2 is a fragmentary, top perspective view of the deck assembly of FIG. 1.
Figure 3:
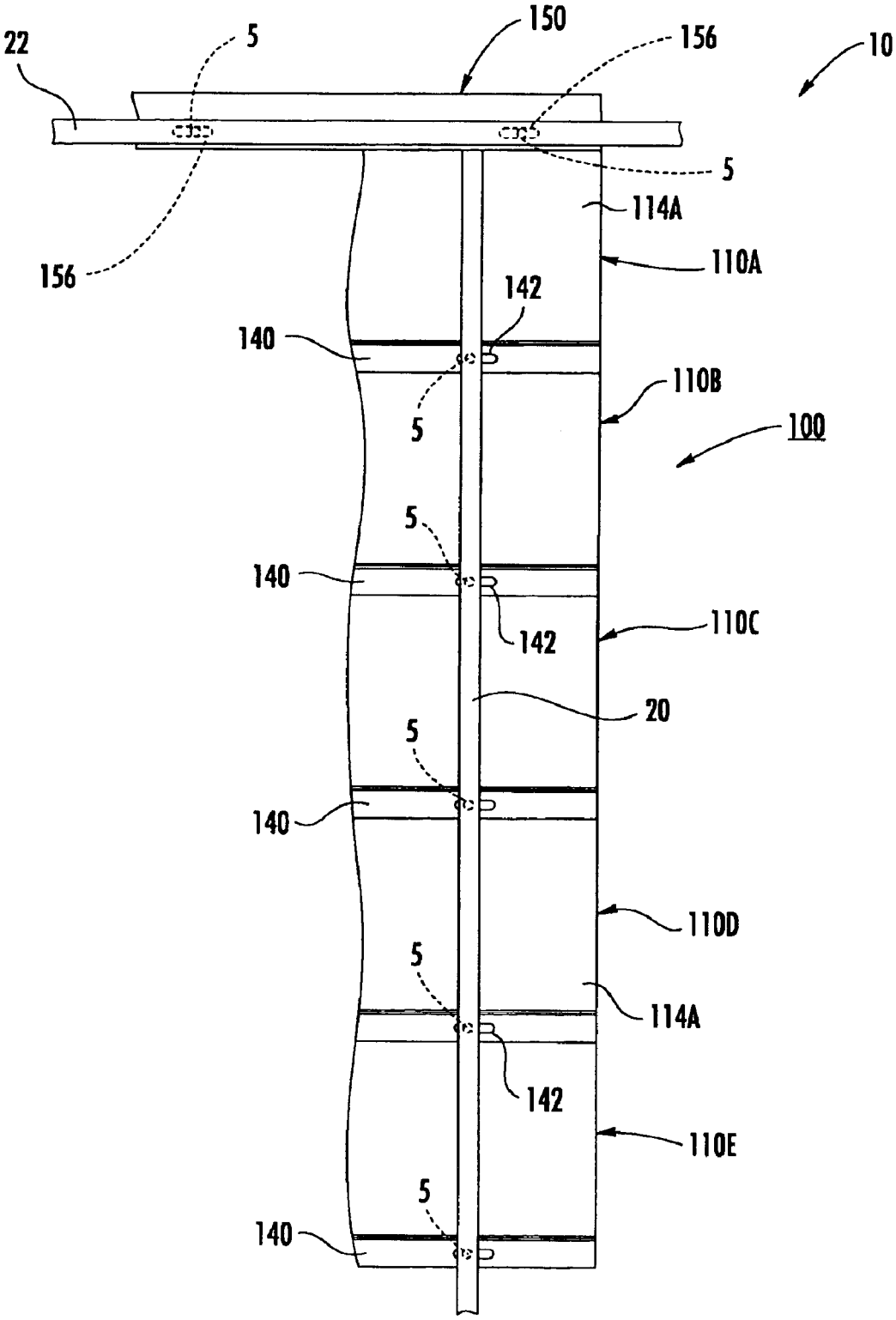
FIG. 3 is a fragmentary, bottom view of the deck assembly of FIG. 1.
Figure 4:
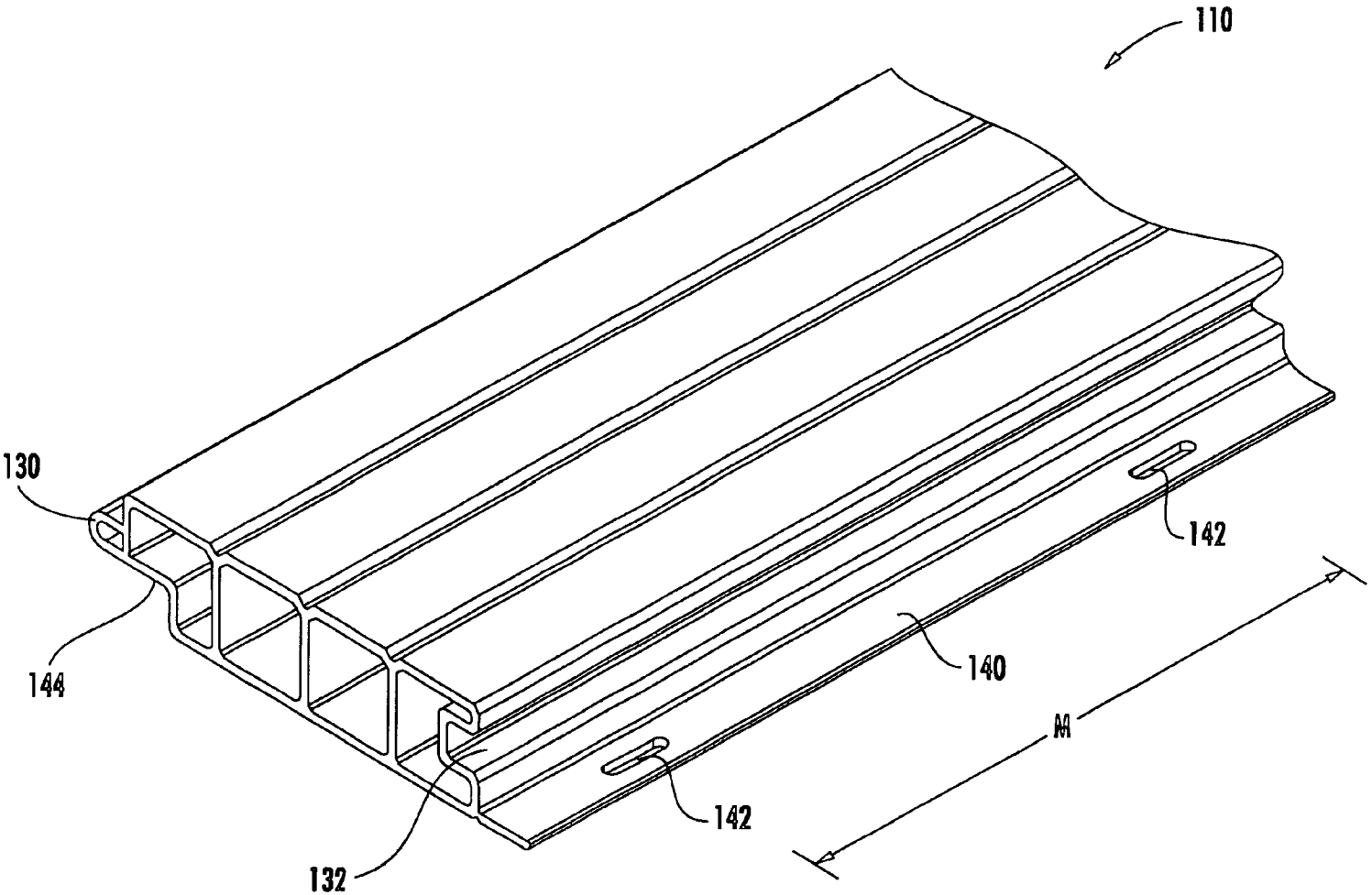
FIG. 4 is a fragmentary, top perspective view of a deck panel forming a part of the deck assembly of FIG. 1.
Figure 5:
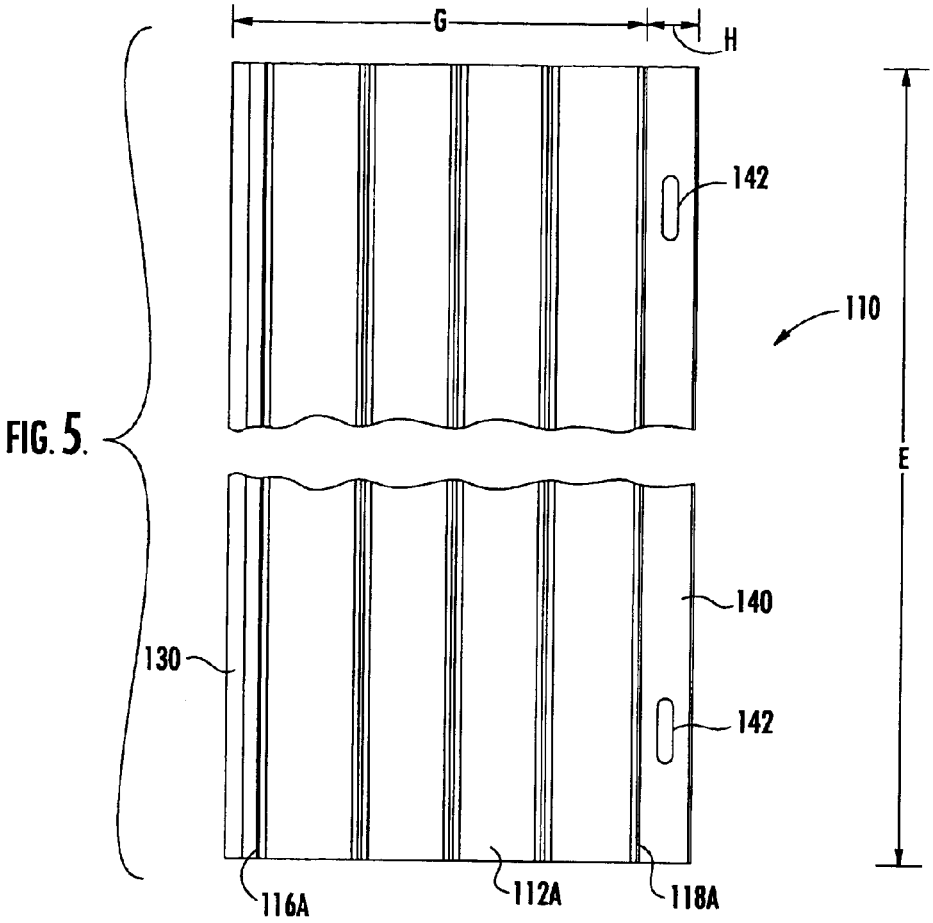
FIG. 5 is a fragmentary, top view of the deck panel of FIG. 4.

The deck assembly 100 is formed from a plurality of deck panels 110 (FIGS. 4–6) according to embodiments of the present invention. The deck assembly 100 may also include fascia strips or members 150 (FIGS. 1–3). With reference to FIGS. 2 and 3, which are fragmentary views of the deck 10, five of these deck panels 110 (deck panels 110A, 110B, 110C, 110D, 110E) are shown therein along with one of the fascia members 150. More or fewer deck panels 110 may be employed. The deck panels 110 and the fascia members 150 are secured to the joists 20 and fascia boards 22 by suitable fasteners 5 such as nails or screws.

Figure 6:
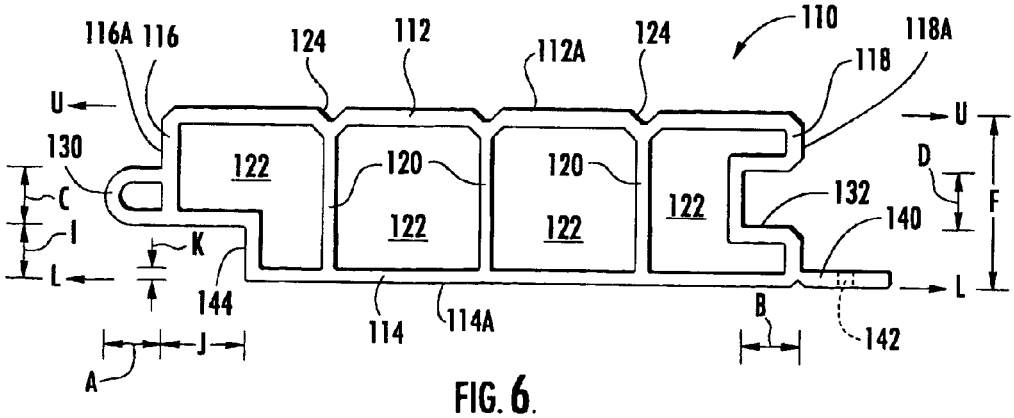
FIG. 6 is an end view of the deck panel of FIG. 4.

The deck panels 110 (including the deck panels 110A–110E) are preferably substantially identical except for variations in length and surface aesthetics as needed or desired. As best seen in FIG. 6, each deck panel 110 includes a generally planar top wall 112, a bottom wall 114, a side wall 116, a side wall 118, and interior walls 120. The top wall 112 has an upper surface 112A defining an upper plane U-U. The bottom wall 114 has a lower surface 114A defining a lower plane L-L. The side wall 116 has an outer side surface 116A. The side wall 118 has an outer side surface 118A. The interior walls 120 along with the walls 112, 114, 116, 118 form lengthwise passages 122. A plurality of lengthwise top channels 124 are formed in the upper surface 112A and may simulate a plurality of individual panels.

An elongated tongue 130 projects outwardly from the side wall 116 beyond the side surface 116A. Preferably, the tongue 130 extends along the full length of the deck panel 110. An elongated groove 132 extends inwardly from the side surface 118A. The groove 132 preferably extends the full length of the deck panel 110.

A fastener strip 140 projects outwardly from the side surface 118A, preferably along the lower plane L-L as shown. A plurality of regularly spaced apart fastener holes or slots 142 are formed in the fastener strip 140. The fastener holes 142 are adapted to receive the fasteners 5 (e.g., nails or screws). Preferably, the fastener holes 142 are periodically located along the full length of the deck panel 110.

A recess 144 is defined in the deck panel 110 adjacent the tongue 130. The recess 144 extends inwardly from the side surface 116A and the lower surface 114A. Preferably, the recess 144 extends along the full length of the deck panel 110.

The deck panel 110 may be formed of any suitable polymeric material. Preferably, the deck panel 110 is formed of a vinyl compound or a composite polymeric compound. More preferably, the deck panel 110 is formed of rigid polyvinyl chloride (PVC). The deck panel 110 is preferably unitarily formed. More preferably, the deck panel is formed by extrusion, with the fastener holes 142 being stamped in the fastener strips 140 after extrusion. The upper surface 112A may be textured or include a coating and/or particles to provide an anti-skid surface.

The preferred dimensions for the deck panel 110 will depend on the application. However, dimensions within the following ranges may be particularly advantageous for use in forming a deck or the like using the polymeric deck panels 110 in place of wooden deck panels on a conventional framework. Preferably, the width A (FIG. 6) of the tongue 130 is between about 0.47 and 0.50 inch. Preferably, the depth B (FIG. 6) of the groove 132 is between about 0.50 and 0.53 inch. More preferably, the depth B is between about 0.01 and 0.02 inch less than the width A of the groove 130. Preferably, the height C (FIG. 6) of the tongue 130 is between about 0.47 and 0.49 inch. Preferably, the height D (FIG. 6) of the groove 132 is between about 0.49 and 0.51 inch. More preferably, the height D is between about 0.01 and 0.02 inch more than the height C of the tongue 130. The initial length E (FIG. 5) of the deck panel 110 is preferably between about 144 and 192 inches. Preferably the height F (from the upper plane U-U to the lower plane L-L; FIG. 6) is between about 1.49 and 1.51 inches. The width G (FIG. 5) from the side surface 116A to the side surface 118A is preferably between about 5.49 and 5.51 inches. The width H (FIG. 5) of the fastener strip 140 is preferably between about 0.775 and 0.795 inch. The height I (FIG. 6) of the recess 144 is preferably between about 0.49 and 0.51 inch. Preferably, the depth J (FIG. 6) of the recess 144 is between about 0.715 and 0.735 inch. Preferably, the thickness K (FIG. 6) of the walls of the deck panel 110 is substantially uniform. Preferably, the thickness K is between about 0.11 and 0.13 inch. The distance M (FIG. 4) between the centers of adjacent fastener holes 142 is preferably 8 inches. The fastener holes 142 are preferably elongated and are between about 0.750 and 0.938 inch long.

The fascia member 150 (FIG. 2) has a lengthwise groove 152 configured the same as the deck panel groove 132. Also, the fascia member 150 has a fastener strip 154 configured the same as the fastener strip 140. A plurality of regularly spaced fastener holes or slots 156 are formed in the fastener strip 154. The fascia member 150 is preferably formed of the same material and by the same methods as described above for the deck panel 110.

The construction of the deck assembly 100 may be better appreciated from the following description of preferred methods for forming the deck assembly 100. As shown in FIGS. 2 and 3, the fascia member 150 is secured to the fascia board 122 by fasteners 5 (e.g., nails or screws), which are inserted through the fastener slots 156.

The deck panel 110A is placed lengthwise across at least one, and preferably two or more, of the joists 20 (only one is shown in FIGS. 2 and 3), preferably such that one of the fastener holes 142 overlies each joist 20. The tongue 130 of the deck panel 110A is inserted into the groove 152 of the fascia member 150 as shown until the side surface 116A of the deck panel 110A is positioned closely adjacent (i.e., no more than 0.063 inch apart) or in abutment with the fascia member 150. The fasteners 5 are driven into the joists 20 through the fastener holes 142 to secure the deck panel 110A to the joists 20 via the fastener strip 140 and the fascia strip 150.

The deck panel 110B is then placed lengthwise across two or more of the joists 20, preferably such that one of the fastener holes 142 overlies each joist 20. The tongue 130 of the deck panel 110B is inserted into the groove 132 of the deck panel 110A as shown until the side surface 116A of the deck panel 110B is closely adjacent or in abutment with the side surface 118A of the deck panel 110A. Fasteners 5 are driven into the joists 20 through the fastener holes 142 of the deck panel 110B to secure the deck panel 110B to the joists 20 via the fastener strip 140 of the deck panel 110B. Thereafter, the deck panels 110C, 110D, 110E are likewise laid and secured in succession as shown in FIGS. 2 and 3.

The deck assembly 100 and the deck panels 110 provide a number of advantages. The deck panels 110 are easy to lay, secure and assemble into the deck assembly 100 because the tongues 130 and grooves 132 assist in properly seating and aligning the deck panels 110. It is only necessary to secure one side of each deck panel 110 with fasteners 5. The cellular structure (i.e., the interior walls 120 and the passages 122) enhance the rigidity and lighten the deck panels 110. The integration provided by the tongues and grooves enhances the strength and rigidity of the overall deck assembly 100. In particular, the tongues and grooves distribute weight to adjacent deck panels 110. The unused portions of the fastener holes 142 not directly overlying the joists 20 may serve as water drain holes for the deck 10.

The tongue and groove arrangement also provides for improved aesthetics. Even when the polymeric deck panels 110 contract, the tongues 130 prevent formation of gaps fully through the deck assembly 100. Also, because the tongues 130 extend between the adjacent deck panels 110, the deck panels 110 may be laid with an expansion gap to allow for expansion of the deck panels 110 without excessive binding and resultant warping or bulging. The channels 124 assist in disguising any gaps between the side surfaces 116A and 118A of adjacent deck panels 110.

The recesses 144 overlying the fastener strips 140 serve to accommodate portions of the fasteners 5 such as the heads of nails or screws. In this way, the recesses 144 may prevent these fastener portions from pushing up the deck panels 110 and deforming the upper surface of the deck assembly 100.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A deck panel comprising:

a) a generally planar body portion having an upper surface and first and second side surfaces on opposed sides of the upper surface;

b) an elongated tongue extending outwardly from and along the first side surface;

c) an elongated groove defined in and extending along the second side surface, the groove being adapted to receive a second tongue;

d) a fastener strip extending outwardly from and along the second side surface, the fastener strip being positioned below the groove; and e) a plurality of regularly spaced apart fastener openings defined in and extending through the fastener strip;

f) wherein the deck panel is formed of a polymeric material; and g) wherein each the fastener openings is elongated along the second side surface and allows for drainage when a fastener is inserted through the respective fastener opening.

2. The deck panel of claim 1 wherein:

the upper surface defines an upper plane;

the body portion has a lower surface defining a lower plane spaced apart from and substantially parallel to the upper plane; and the tongue and the groove are each disposed between and spaced apart from each of the upper and lower planes.

3. The deck panel of claim 1 wherein the centers of the fastener openings are regularly spaced at intervals of about eight inches.

4. The deck panel of claim 1 defining a recess in the first side surface and located below the tongue.

5. The deck panel of claim 1 wherein:

a) the body portion includes top and bottom opposed walls and first and second side walls extending between the top and bottom walls, the tongue extending from the first side wall and the groove being formed in the second side wall; and b) the top wall, the bottom wall, the first side wall and the second side wall define a interior chamber.

6. The deck panel of claim 5 including an interior wall disposed within the interior chamber and extending from the top wall to the bottom wall, the interior wall partitioning the interior chamber into a plurality of passages.

7. The deck panel of claim 1 including a channel formed in the upped surface to simulate a plurality of individual panels.

8. The dock panel of claim 1 wherein the upper surface has an anti-skid feature.

9. The deck panel of claim 1 wherein the deck panel is unitary.

10. The deck panel of claim 1 wherein the deck panel is extruded.

11. The deck panel of claim 1 wherein the polymeric material from which the deck panel is formed is selected from the group consisting of vinyl compound and composite polymeric compound.

12. The deck panel of claim 1 having a length of between about 144 and 192 inches.

13. The deck panel of claim 1 wherein the tongue and the groove extend the full length of the body portion.

14. A deck assembly comprising first and second deck panels, each of the first and second deck panels including:

a) a generally planar body portion having an upper surface and first and second side surfaces on opposed sides of the upper surface;

b) an elongated tongue extending outwardly from and along the first side surface; and c) an elongated groove defined in and extending along the second side surface;

d) wherein each deck panel is formed of a polymeric material;

e) wherein the first and second deck panels are disposed in side-by-side arrangement such that the tongue of the second deck panel is disposed within the groove of the first deck panel;

f) wherein each of the first and second deck panels includes a fastener strip extending outwardly from and along the second side surface thereof, the fastener strip being positioned below the groove thereof;

g) wherein each of the first and second deck panels includes a recess in the first side surface and located below the tongue thereof; and h) wherein the width of the fastener strips is greater than the depth of the recesses.

15. The deck assembly of claim 14 wherein the first side surface of the second deck panel is positioned closely adjacent or in abutment with the second side surface of the first deck panel.

16. The deck assembly of claim 14 further including a third deck panel formed in the same manner as the first and second deck panels, wherein the second and third deck panels are disposed in side-by-side arrangement such that the tongue of the third deck panel is disposed within the groove of the second deck panel.

17. The deck assembly of claim 14 wherein each of the first and second deck panels includes a fastener strip extending outwardly from and along the second side surface thereof, the fastener strip being positioned below the groove thereof.

18. The deck assembly of claim 17 including a plurality of regularly spaced apart fastener openings defined in the fastener strips.

19. The deck assembly of claim 14 including a fascia member defining a fascia groove, wherein the tongue of the first deck panel is disposed in the fascia groove.

20. The deck assembly of claim 19 wherein the fascia member is formed of a polymeric material.

21. The deck assembly of claim 19 wherein the fascia member includes a fastener strip extending outwardly therefrom, the fastener strip being positioned below the fascia groove.

22. The deck assembly of claim 21 including a plurality of regularly spaced apart fastener openings defined in the fastener strip of the fascia member.

23. The deck assembly of claim 14 wherein each of the first and second deck panels includes a recess in the first side surface and located below the tongue thereof.

24. The deck assembly of claim 14 wherein each of the first and second deck panels is unitary.

25. The deck assembly of claim 14 wherein each of the first and second deck panels is extruded.

26. The deck assembly of claim 14 wherein the polymezic material from which each of the first and second deck panels is formed is selected from the group consisting of vinyl compound and composite polymeric compound.

27. A deck comprising:

a) a deck assembly including first and second deck panels, each of the first and second deck panels including:

a generally planar body portion having an upper surface and first and second side surfaces on opposed sides of the upper surface;

an elongated tongue extending outwardly from and along the first side surface; and an elongated groove defined in and extending along the second side surface;

wherein each deck panel is formed of a polymeric material;

wherein the first and second deck panels are disposed in side-by-side arrangement such that the tongue of the second deck panel is disposed within the groove of the first deck panel;

wherein each of the first and second deck panels includes a fastener strip extending outwardly from and along the second side surface thereof, the fastener strip being positioned below the groove thereof;

wherein each of the first and second deck panels includes a recess in the first side surface and located below the tongue thereof; and wherein the width of the fastener strips is greater than the depth of the recesses; and b) a joist extending below and supporting each of first and second deck panels.

28. The deck of claim 27 further including a third deck panel formed in the same manner as the first and second deck panels, wherein:

a) the second and third deck panels are disposed in side-by-side arrangement such that the tongue of the third deck panes is disposed within the groove of the second deck panel; and b) the joist extends below and supports the third deck panel.

29. The deck of claim 27 wherein:

a) each of the first and second deck panels includes a fastener strip extending outwardly from and along the second side surface thereof, the fastener strip being positioned below the groove thereof; and b) the deck further includes a plurality of fasteners extending through the fastener strips of the first and second deck panels to secure the first and second deck panels to the joist.

30. The deck of claim 29 including:

a) a plurality of joists extending below and supporting each of the first and second deck panels;

b) a plurality of regularly spaced apart fastener openings defined in the fastener strip at locations corresponding to the plurality of joists; and c) a plurality of fasteners extending through the fastener openings of the first and second deck panels to secure the first and second deck panels to respective ones of the joists.

31. The deck of claim 27 further including a fascia board and wherein:

a) the deck assembly further includes a fascia member secured to the fascia board;

b) the fascia member defines a fascia groove; and c) the tongue of the first deck panel is disposed in the fascia groove.

32. The deck of claim 31 wherein the fascia member is formed of a polymeric material.

33. The deck of claim 31 wherein:

a) the fascia member includes a fastener strip extending outwardly therefrom, the fastener strip being positioned below the fascia groove; and b) the deck includes at least one fastener extending through the fastener strip and securing the fascia member to the fascia board.

34. The deck assembly of claim 14 wherein a front end of the tongue of the second deck panel is spaced apart from a rear wall of the groove of the first deck panel.

35. The deck assembly of claim 14 wherein the height of the groove of the first deck panel is between about 0.01 and 0.02 inch more than the height of the tongue of the second deck panel.

36. The deck panel of claim 1 including a recess in the first side surface and located below the tongue thereof, wherein the width of the fastener strip is greater than the depth of the recess.

37. The deck of claim 27 wherein a front end of the tongue of the second deck panel is spaced apart from a rear wall of the groove of the first deck panel.

38. The deck of claim 27 wherein the height of the groove of the first deck panel is between about 0.01 and 0.02 inch more than the height of the tongue of the second deck panel.

39. The deck assembly of claim 14 including:

a passage defined within the body portion between the groove and the lower surface; and an end wall extending vertically along the second side surface from the lower surface to the groove;

wherein the deck panel is formed of a polymeric material.

40. The deck panel of claim 39 wherein the body portion includes a bottom wall defining the lower surface, and the bottom wall forms a right angle with the vertically extending end wall.

* * * * *

UNITED STATES PATENT AND TRADEMARK OFFICE

CERTIFICATE OF CORRECTION

PATENT NO. : 6,918,221 B2
DATED : July 19, 2005
INVENTOR(S) : Williams

It is certified that error appears in the above-identified patent and that said Letters Patent is hereby corrected as shown below:

Column 7,
Line 64, should read -- third deck panel is disposed within the groove of the --.

Signed and Sealed this

Twenty-seventh Day of December, 2005

JON W. DUDAS
*Director of the United States Patent and Trademark Office*